US005577632A

United States Patent [19]

Blanchette et al.

[11] Patent Number: 5,577,632

[45] Date of Patent: Nov. 26, 1996

[54] PAIL SAFETY RING

[75] Inventors: Henry J. Blanchette, Leominster; Paul Mercadante, Ipswich, both of Mass.

[73] Assignee: Plastican, Inc., Leominster, Mass.

[21] Appl. No.: 538,355

[22] Filed: Oct. 3, 1995

Related U.S. Application Data

[63] Continuation of Ser. No. 187,697, Jan. 27, 1994, abandoned.

[51] Int. Cl.[6] ..... B65D 1/40

[52] U.S. Cl. ..... 220/730; 220/212; 220/256; 220/258; 220/306; 220/701

[58] Field of Search ..... 220/212, 256, 220/258, 306, 307, 353, 529, 695, 697, 698, 699, 700, 701, 702, 730, 734; 206/315.6, 372, 373

[56] References Cited

U.S. PATENT DOCUMENTS

| | | | |
|---|---|---|---|
| 1,417,380 | 5/1922 | Hatch | 206/315.6 |
| 1,696,240 | 12/1928 | Kircher, Jr. | 220/698 X |
| 3,394,861 | 7/1968 | Traux | 229/123.1 X |
| 3,447,262 | 6/1969 | Uhl | 220/306 X |
| 3,945,527 | 3/1976 | Plyant | 220/695 X |
| 4,004,710 | 1/1977 | Crisci . | |
| 4,947,998 | 8/1990 | Smeller | 206/373 X |
| 5,103,993 | 4/1992 | Bingisser . | |
| 5,183,179 | 2/1993 | Morris, Sr. | 220/730 X |
| 5,350,065 | 9/1994 | Darrey | 206/373 |

*Primary Examiner*—Jes F. Pascua
*Attorney, Agent, or Firm*—Pandiscio & Pandiscio

[57] ABSTRACT

A safety ring for a pail to prevent access to the contents of the pail by a small child. The ring is adapted to fit within and interlock with a pail. Preferably the safety ring is assembled with the lid for the pail, but is separable from the lid once the lid has been attached to the pail, whereupon the ring will remain in the pail when the lid is removed to expose the contents of the pail.

21 Claims, 3 Drawing Sheets

PAIL SAFETY RING

This is a continuation of U.S. application Ser. No. 08/187,697 filed Jan. 27, 1994 for "Pail Safety Ring"; now abandoned.

This invention relates to containers which comprise a pail and a removable lid or cover, and is more particularly concerned with pails having a safety ring associated with a lid and pail.

BACKGROUND OF THE INVENTION

Plastic containers in various sizes are widely manufactured and used. Existing conventional designs of plastic containers, of the type used for paint and other liquids, typically have a closure in the form of a lid or cover that is attached to the pail by a snap-fit or by a screw-on connection.

Once the lid is removed, the contents of the pail are completely exposed. When the pail is used in an environment where small children are present, their curiosity may cause them to look into the pail to view its contents. If the pail contains a liquid the child may put its head in the pail and may fall or tumble into the interior of the pail and possibly drown. Containers of the type which present the greatest danger are the 5-gallon pail size, since a small child's head can readily be immersed in the contents of such a pail.

A satisfactory and simple solution to this problem has not yet been made available.

SUMMARY OF THE INVENTION

It is therefore one object of the invention to provide plastic pails containing liquids with a means for preventing a small child from drowning in such liquids.

A further object of the invention is to provide a plastic pail having a safety ring with elements which partially restrict the opening of the pail so as to prevent a child's head from passing through the pail opening into the interior of the pail.

Still another object of the invention is to provide a safety ring for pails which can he employed with a snap-on or screw-on lid, wherein the safety ring is snapped into position so as to provide a restriction for the pail opening while permitting pouring out of liquid contents of the pail.

A still further object of the invention is to provide a safety ring for use with either a screw-on or snap-on lid for a container, which can be separately assembled to the lid and placed into a pail, and thereafter be retained therein.

In a preferred embodiment of the invention, the foregoing objects are attained by providing the combination of a removable container or lid and a safety ring which is detachably assembled to the cover or lid, with the safety ring being detachable from the cover or lid so as to remain in place within the container when the cover or lid is subsequently removed.

Other features and advantages of the invention are set forth in or rendered obvious by the following detailed description of a preferred embodiment of the invention, which is to be considered together with the drawings hereinafter described.

BRIEF DESCRIPTION OF THE DRAWINGS

In the drawings, like parts and elements thereof are identified by like numerals.

DETAILED DESCRIPTION OF THE INVENTION

Figure 1:
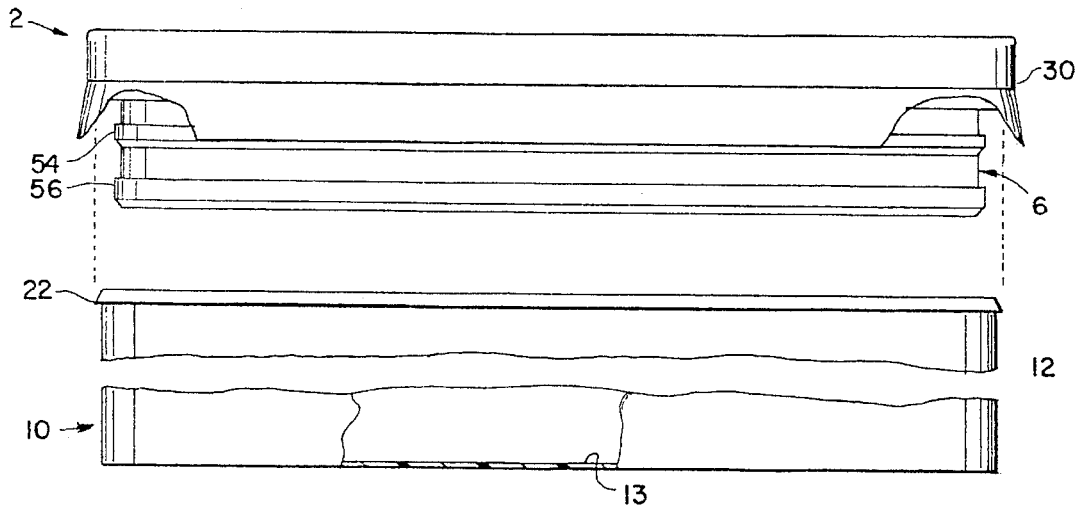
FIG. 1 is an exploded side view in elevation of a preferred embodiment of the invention comprising a container, a snap-on lid for the container, and a safety ring constructed in accordance with the teachings of the present invention, with the lid broken away to illustrate portions of the safety ring.

A preferred embodiment of the invention is shown in FIGS. 1–4, wherein a plastic lid or cover 2 and a plastic safety ring 6 are combined with a plastic container 10. By way of example, container 10 may be a pail of the type shown in U.S. Pat. Nos. 5,103,993 and 4,004,710. Lid 2, safety ring 6 and container 10 are preferably made by injection molding.

As described hereinafter, it is preferred that the invention be practiced by assembling safety ring 6 to lid 2 before the lid is attached to pail 10, with ring 6 and lid 2 being coupled together as a separable pre-assembly by retaining means which permit the two to be separated from one another when the lid is removed from the pail, whereby to permit access to the contents of the pail while obstructing introduction into the pail of a large foreign body, e.g., the head of a child.

Figure 4:
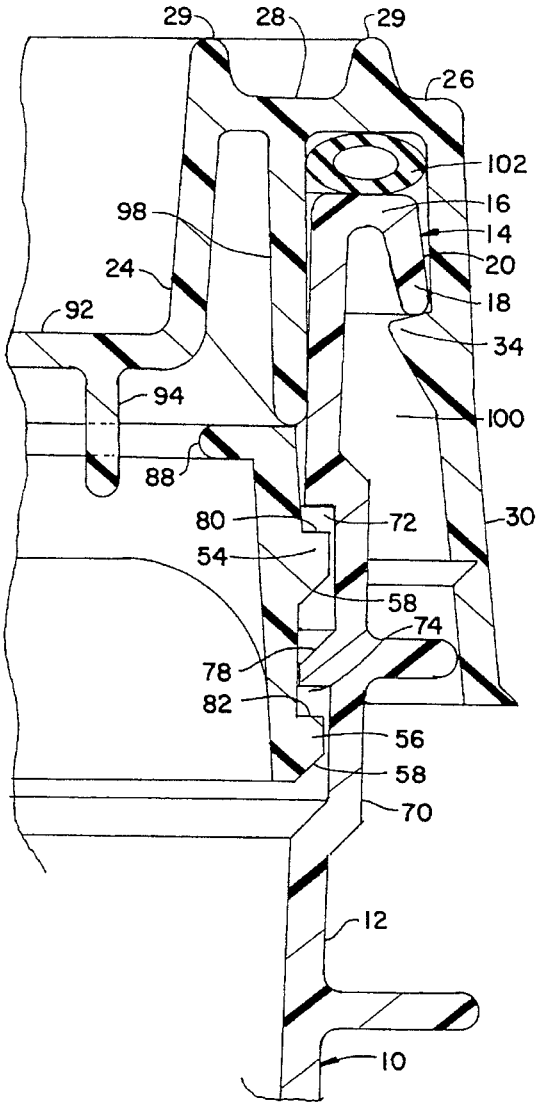
FIG. 4 is a fragmentary cross-sectional view on an enlarged scale showing how the safety ring of FIGS. 1–3 is disposed in the container when it is closed off by the lid.

Referring now to FIGS. 1 and 4, container 10 comprises a side wall 12 and a bottom end wall 13. The upper end of side wall 12 has an annular locking flange 14 on its outer periphery to permit secure attachment and retention of lid 2 by a snap-fit connection. Locking flange 14 is generally L-shaped in cross-section, comprising an annular inner section 16 that is formed integral with side wall 12 and an outer section 18 having an outer surface 20 that is tapered as shown in FIG. 4 to facilitate application of lid 2 by a snap-fit.

Lid 2 is of the snap-on type, having a crown section 24 (FIG. 4) and a rim section 26 comprising an end wall 28 and a depending side wall 30 that functions as a skirt. In this particular embodiment, end wall 28 is provided with a pair of upstanding annular ribs 29 that strengthen the lid and also serve as stacking guides to permit containers to be stacked one upon the other. Preferably, as shown in FIGS. 1 and 4, at least the lower part of side wall 30 is tapered so as to flair outwardly, whereby to facilitate application of lid 2. Side wall 30 is provided with an annular rib 34 on its inside surface. Rib 34 is sized and shaped so that it can be snapped over and into frictional locking engagement with locking flange 14 when the lid is pressed onto the container. Although rib 34 is preferably a continuous element extending for the full circumference of the inner surface of side wall 30, it may be replaced by a series of short, circumferentially-extending rib sections that are spaced from one another about the inner periphery of side wall 30.

Figure 2:
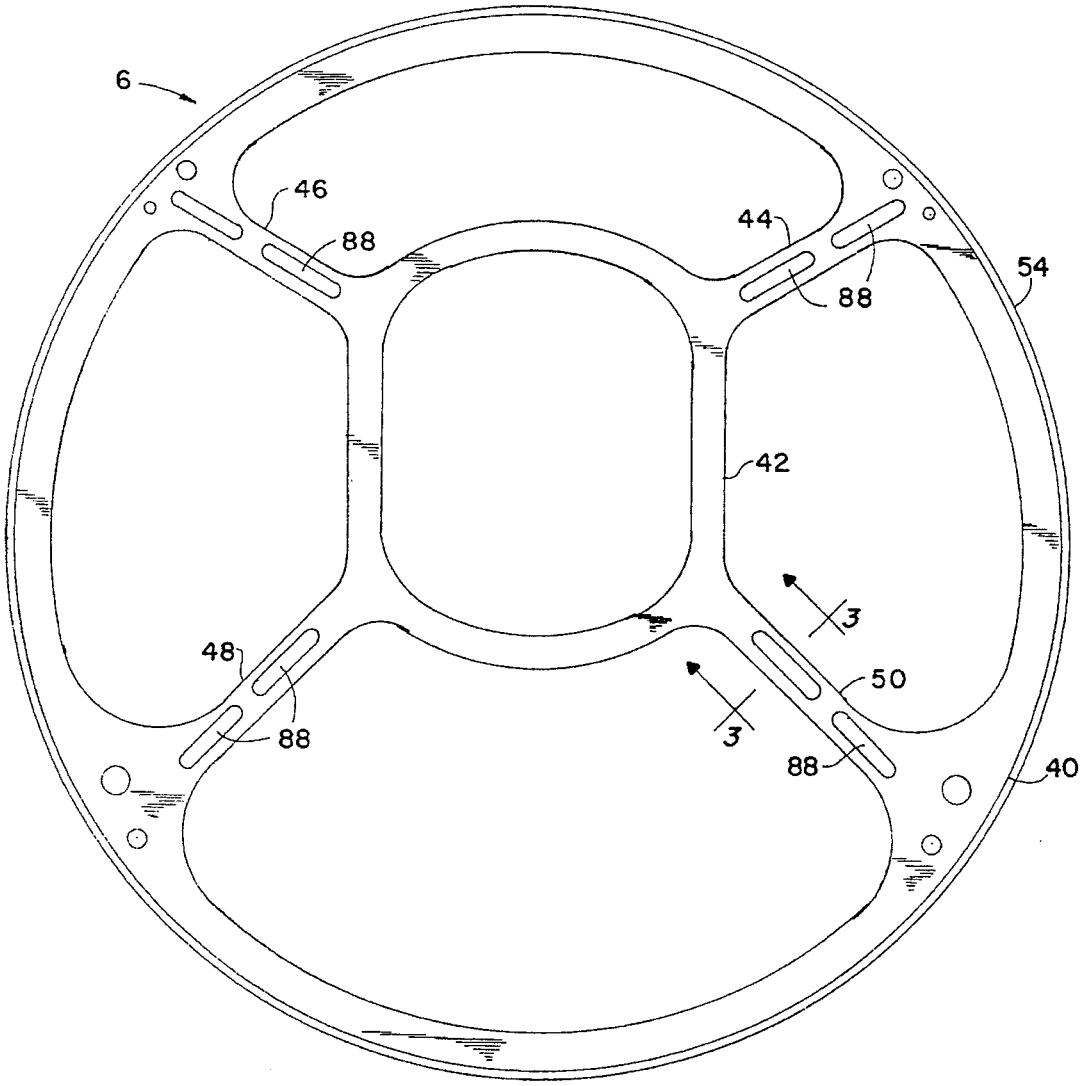
FIG. 2 is a plan view of the safety ring shown in FIG. 1.
Figure 3:
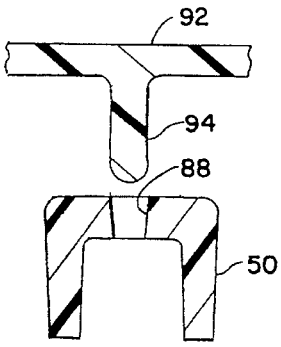
FIG. 3 is a an exploded cross-sectional view taken substantially along line 3—3 of FIG. 2, showing details of the retention means for coupling the safety ring to the lid.

Safety ring 6 may take various configurations. The preferred form is illustrated in FIGS. 2 and 3, where ring 6 is shown as comprising an outer annular rim 40 and an inner oval shaped ring 42. Rim 40 and inner ring 42 are joined together by a series of struts or ribs 44, 46, 48 and 50 of U-shaped cross-section. These struts provide a strong support for ring 42. Preferably, rim 40 is tapered as shown in FIG. 4, having its smallest outside diameter at its junction with the four struts.

In addition, rim 40 of ring 6 is formed with a pair of mutually-spaced circumferential ribs 54 and 56 on its outer surface. These ribs form one part of a two-part means for retaining the safety ring in container 10. The undersides of ribs 54 and 56 are bevelled as shown at 58 and 59, respectively; When ring 6 is mounted in the mouth of a container as hereinafter described, struts 44, 46, 48 and 50 and inner ring 42 coact to provide a barrier to prevent a large foreign body, such as a child's head, from being introduced into the container.

Side wall 12 of the container is provided with the second part of the two-part means for retaining the safety ring in container 10. For this purpose, side wall 12 comprises an enlarged diameter section 70 (FIG. 4) which is formed with two axially-spaced grooves 72 and 74 separated by an inner rib 78 of rectangular cross-section. Grooves 72 and 74 have a rectangular shape in cross-section and are sized to accommodate the external ribs 54 and 56 on ring 6. Preferably but not necessarily, the maximum diameter of grooves 72 and 74 is set so that ribs 54 and 56 make a close but not tight fit therein. Also the outer diameters of ribs 54 and 56 are slightly larger than the minimum inside diameter of that portion of pail wall 70 that is above groove 72. Ribs 54 and 56 are made with an o.d. just large enough to tightly engage the inner surface of side wall 12 of the pail above groove 72, but not so large as to prevent the ring from being forced downward in the pail far enough to allow ribs 54 and 56 to slip into grooves 72 and 74. It is to be noted that typically the side wall of an injection molded plastic container such as a pail has a slight taper, tapering inwardly with increasing distance from its top end. Preferably the height of grooves 72 and 74 is substantially greater than the corresponding dimension of ribs 54 and 56 (as shown in FIG. 4), so as to facilitate insertion of ring 6 into container 10. When safety ring 6 is pushed into container 10 to the position shown in FIG. 4, ribs 54 and 56 will be forced into the respective grooves 72 and 74. Once placed into this position, the ring is blocked against removal from the pail because of the shape of ribs 54 and 56, since rib 54 has a flat annular horizontally extending (as viewed in FIG. 4) upper surface 80 and rib 56 has a like upper surface 82. If an attempt is made to remove the safety ring by pulling it upwardly, the upper surfaces of grooves 72 and 74 will intercept the flat upper surfaces 80 and 82 of ribs 54 and 56, preventing any further vertical movement of the safety ring.

As indicated above, it is preferred, but not essential, that safety ring 6 be pre-assembled to lid 2. In the preferred embodiment the two parts are held together by a pin and hole arrangement as shown in FIGS. 2–4. More particularly, each strut of ring 6 is provided with at least one and preferably two elongate holes 88. Crown section 24 of lid 2 has a depressed flat center portion 92 that is provided with a plurality of depending pins 94 (FIGS. 3 and 4) that are disposed so as to be aligned with elongate holes 88. Pins 94 are round and have an outside diameter that is slightly greater than the width of holes 88, i.e., the horizontal dimension of hole 88 as seen in FIG. 3. Lid 2, ring 6 and pail 10 are molded of a plastic material, e.g., polyethylene or polypropylene, which is formulated so as to be sufficiently resilient to permit the pins 94 to be compressed and holes 88 to expand enough to allow the pins to be pushed into and make a relatively tight fit in holes 88.

As shown in FIG. 4, rim section 26 of lid 2 comprises an annular inner wall 98 that is spaced from side wall 30 so as to form a channel 100 for receiving the upper end of container 10. Channel 100 is made large enough to accept flange 14 in a snap fit connection with rib 34, as shown in FIG. 4. As noted above, the outer surface 20 of flange 14 is sloped as shown so as to facilitate application of lid 2 by a press fit. Since the pail is made of a material such as polyethylene or polystyrene, both flange 14 and skirt 30 are sufficiently resilient to yield under pressure to the extent required to permit lid 2 to make a snap-type lock fit with flange 14. In this embodiment, lid 2 has a resilient annular seal 102 disposed in channel 100, and that seal is captured between the underside of end wall 28 and the top surface of inner section 16 of flange 14, so as to make a tight seal between the pail and lid.

As suggested hereinabove, it is preferred that the lid 2 and safety ring 6 be pre-assembled together by forcing the pins 94 into holes 88 in the safety ring. When this has been accomplished, the lid and safety ring will become a single unit for the purposes of subsequent attachment to a container after the latter has been filled with a predetermined commodity, e.g., a solid swimming pool disinfectant.

Assuming that safety ring 6 has been pre-assembled to lid 2, when lid 2 is pressed onto the container so as to make a snap fit connection, safety ring 6 will automatically be forced into locking engagement with grooves 72 and 74. When lid 2 is pried off of the container, the locking engagement of container side wall 12 with ring 6 will be stronger than the locking engagement of pins 94 and struts 44, 46, 48 and 50, with the result that the pins will pull out of holes 88, leaving ring 6 in the container.

Figure 5:
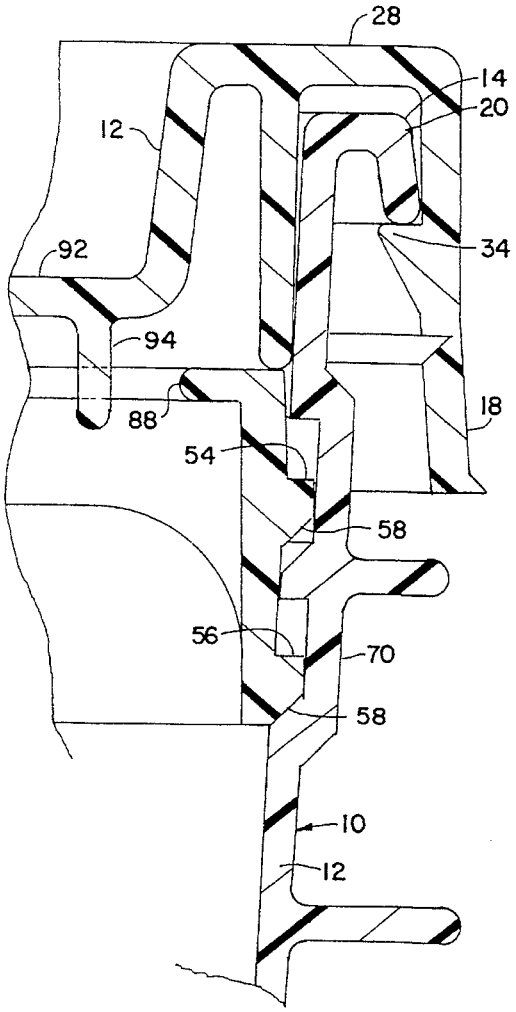
FIG. 5 is a partial cross-sectional view similar to FIG. 4, but omitting a gasket seal between the lid and container.

FIG. 5 shows a container/lid arrangement like that of FIG. 4, except that no gasket is used between the rim section and flange 14B of container 10B. Also, in this case the upper surface of end wall 28B is flat instead of having ribs 29 as shown in FIG. 4.

Figure 6:
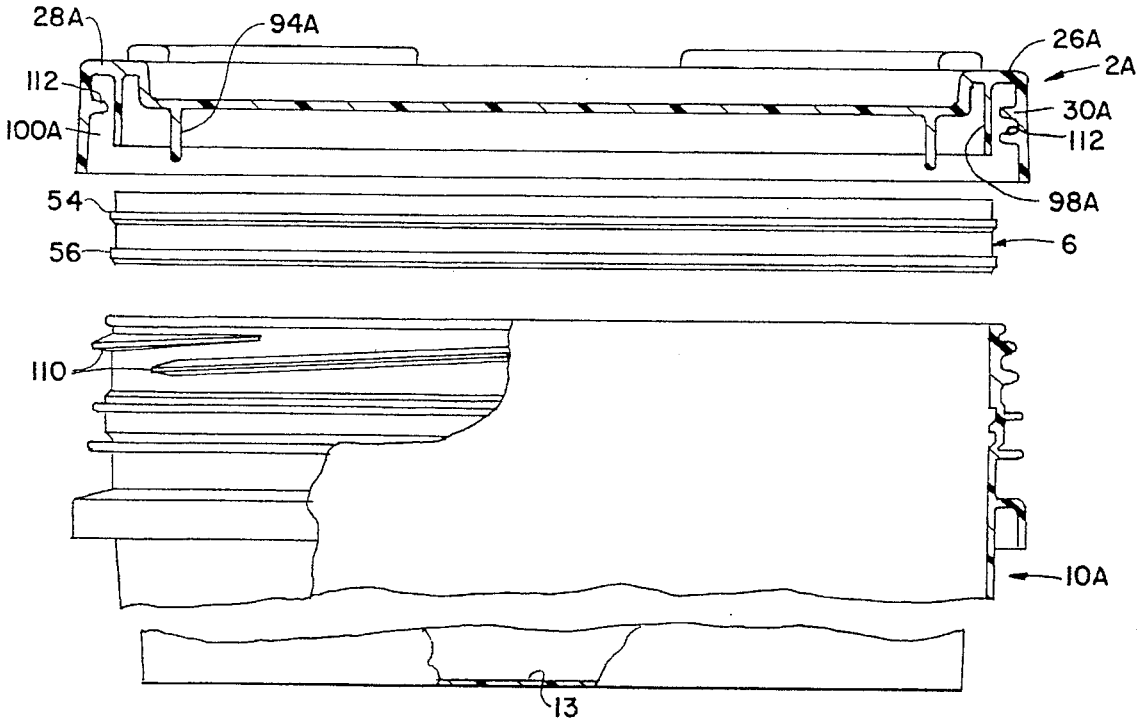
FIG. 6 is an exploded side view in elevation illustrating use of the invention with a screw-type lid.
Figure 7:
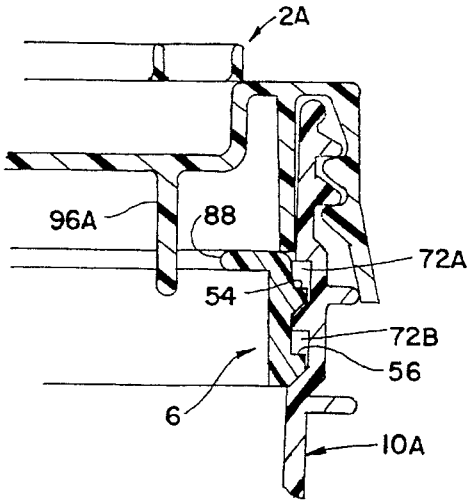
FIG. 7 is a fragmentary sectional view showing how the components of FIG. 6 fit together.

Referring now to FIGS. 6 and 7, the invention is equally applicable to screw-on lids. In the embodiment shown in FIGS. 6 and 7, the upper end of container 10A has a plurality of helical screw threads 110 in place of flange 14 of the embodiment of FIGS. 1–4. Preferably four equally spaced screw threads are provided, each extending for about 135 degrees, with the leading end of each thread overlapping the trailing end of another thread by the same amount. Similarly lid 2A has a rim section 26A having a top end wall 28A and a skirt 30A, plus a depending internal wall 98A similar to wall 98 described above. Skirt 30A and internal wall 98A form a channel 100A for receiving the upper end of container 10A. Skirt 30A is formed with a plurality of internal screw threads 112 that are shaped, sized and spaced to mate with screw threads 110 to make a screw-type locking connection. Lid 2A has pins 94A like pins 94 that extend into holes 88A so as to make a tight but releasable connection with safety ring 6A. The latter may be inserted into container 10A before the lid is applied, or it may be pre-assembled to lid 2A, so that it automatically is forced downward into locking engagement with grooves 72A and 74A when the lid is screwed onto the container. In the case where ring 6A is pre-assembled to lid 2A and the lid is screwed onto the container, ring 6 will rotate with the lid but will also be forced down into the container into grooves 72A and 74A.

It should be noted that a common industry practice is to apply a screw-type lid to a container by a downward, non-rotating propulsion of the lid with respect to the container, i.e., by a press-on action. Since the lid, or container, or both, are made of a resilient material, attaching a screw lid like lid 2A to container 10A by a simple press-on action to achieve a snap-on connection is not only feasible, but preferred.

Further with respect to FIGS. 6 and 7, the safety ring will remain in place in container 10A when lid 2A is removed by unscrewing, even though ring 6A may be free to rotate in the container, since the flat upper surfaces of grooves 72A and 74A combine with the flat upper surfaces of ribs 54A and 56A to prevent the ring from coming out of the pail as the lid is unscrewed. As the lid moves up during the unscrewing procedure, pins 88A will separate from holes 94A of the ring.

Although, as shown in the embodiment of FIGS. 1–4, safety ring 6 comprises an inner ring 42 that is located in an off-center position with respect to its outer rim 40, it is to be understood that a centered inner ring may also be employed. Also, although grooves 72, 74 and ribs 54, 56 are shaped to resist removal of ring 6 from container 10, it is to be appreciated that ring 6 may be sized so as to permit easy removal from the container by a manual force. These and other modifications may be made within the teaching of the invention without departing from the spirit and scope thereof.

What is claimed is:

1. A container lid for use with a pail in combination with a means for preventing ingress by small children into a pail to which the lid is attached, said ingress-preventing means comprising a rim section and an object-intercepting section surrounded and supported by and spaced from said rim section, said rim section having a side wall with means for making a releasable locking connection with a pail to which said lid is attached, said object-intercepting section comprising an inner ring joined to said rim section by a plurality of strut members and at least one opening to enable access to the contents of a pail to which said ingress-preventing means is connected.

2. Apparatus according to claim 1 wherein at least some of said strut members are provided with means for enabling the attaching of said ingress-preventing means to said lid.

3. Apparatus according to claim 2 wherein said lid is provided with at least one retention element so located as to be capable of being engaged with said enabling means on said strut members.

4. A container lid according to claim 1 wherein said means for making a releasable locking connection with a pail comprises at least one peripheral rib on said rim section.

5. A container lid according to claim 4 in combination with a pail, said pail having at least one interior groove into which said at least one peripheral rib may be disposed.

6. A container lid for use with a pail and an ingress-preventing means for preventing ingress by small children into a pail to which the lid is attached, said ingress-preventing means being releasably attached to said lid and comprising a rim section of limited width defining an opening large enough to permit the passage of a child's head therethrough, said ingress-preventing means also comprising an object intercepting section extending across said opening, said rim section having a side wall with means for making a releasable locking connection with a pail to which said lid is attached, and said object intercepting section being arranged to prevent the passing of a child's head through said ingress-preventing means into a container to which said lid is attached, said object intercepting section also having at least one opening to enable access to the contents of a pail to which said ingress-preventing means is connected.

7. A container apparatus comprising:

a container having a side wall defining the interior space of said container, a bottom end that is closed off by an end wall attached to said side wall, and a top end having an opening to said interior space, said opening being of such dimension as to readily permit a child's head to pass therethrough;

a lid releasably attached to said top end so as to close off said opening; and means for preventing ingress into said container by the head of a child when said lid is removed, said ingress-preventing means being mounted within said container adjacent said top end, said ingress preventing means being attached to said side wall and comprising (1) an object-intercepting section extending inwardly of said side wall and extending across the opening in the top end of said container in position to prevent introduction of a child's head into said interior space, and (2) at least one opening that permits access to the contents of said container or through which the contents of said container may be discharged.

8. A container apparatus according to claim 7 wherein said ingress-preventing means comprises an outer rim section interlocked with said side wall, and said object-intercepting section comprises a ring spaced inwardly of said outer rim section.

9. A container apparatus according to claim 8 wherein said ring and said outer rim section are joined together by a plurality of struts.

10. A container apparatus according to claim 7 wherein said side wall and said ingress preventing means have interacting means for retaining said ingress preventing means within said container when said lid is removed.

11. A container apparatus according to claim 10 wherein said interacting means for retaining said ingress preventing means within said container comprises at least one indentation in said side wall and at least one projection on said ingress preventing means received by said at least one indentation.

12. A container apparatus according to claim 10 wherein said ingress preventing means comprises an outer rim section attached to said side wall, an inner object-intercepting ring section disposed inwardly of and surrounded by said outer rim section, and a plurality of struts extending between said rim section and said ring section.

13. A container apparatus according to claim 12 wherein said interacting means for retaining said safety means within said container comprises at least one groove in said side wall and at least one peripheral rib on said rim section disposed in said at least one groove.

14. A container apparatus comprising:

a container having a side wall defining the interior space of said container, a bottom end that is closed off by an end wall attached to said side wall, and a top end having an opening to said interior space;

a lid releasably attached to said top end so as to close off said opening; and means for preventing ingress into said container by small children when said lid is removed, said ingress preventing means being mounted within said container adjacent said top end and being attached to said side wall, said ingress-preventing means comprising (1) an object-intercepting section extending inwardly of said side wall and spanning said opening in said top end of said container in position to prevent introduction of a child's head into said interior space, and (2) at least one opening that permits access to the contents of said container or through which the contents of said container may be discharged;

said ingress preventing means being releasably attached to said lid.

15. A container apparatus comprising:

a container having a side wall defining the interior space of said container, a bottom end that is closed off by an end wall attached to said side wall, and a top end having an opening to said interior space;

a lid releasably attached to said top end so as to close off said opening; and ingress-preventing means for preventing ingress into said container by small children when said lid is removed, said ingress-preventing means being mounted within said container adjacent said top end, said ingress-preventing means being attached to said side wall and comprising (1) an outer rim section interlocked with said side wall, and (2) an object-intercepting section extending inwardly of said side wall and spanning the opening in the top end of said container in position to prevent introduction of a child's head into said interior space, said object-intercepting section having at least one opening that permits access to the contents of said container or through which the contents of said container may be discharged;

said object-intercepting section comprising a ring and a plurality of struts joining said ring to said rim section; and at least some of said struts being provided with means for permitting attachment of said ingress-preventing means to said lid.

16. A container apparatus comprising:

a container having a side wall defining the interior space of said container, a bottom end that is closed off by an end wall attached to said side wall, and a top end having an opening to said interior space;

a lid releasably attached to said top end so as to close off said opening;

ingress-preventing means for preventing ingress into said container by small children when said lid is removed, said ingress-preventing means being mounted within said container adjacent said top end, said ingress-preventing means being attached to said side wall and comprising an object-intercepting section extending inwardly of said side wall and spanning the opening in the top end of said container in position to prevent introduction of a child's head into said interior space, said object-intercepting section having at least one opening that permits access to the contents of said container or through which the contents of said container may be discharged, said ingress-preventing means also comprising an outer rim section interlocked with said side wall, said object-intercepting section being attached to, spaced from, and supported by said outer rim section; and means on said lid for permitting attachment of said ingress-preventing means to said lid.

17. A container apparatus comprising:

a container having a side wall defining the interior space of said container, a bottom end that is closed off by an end wall attached to said side wall, and a top end having an opening to said interior space;

a lid releasably attached to said top end so as to close off said opening;

means for preventing ingress into said container by small children when said lid is removed, said ingress-preventing means being mounted within said container adjacent said top end, said ingress-preventing means being attached to said side wall and comprising (1) an object-intercepting section extending inwardly of said side wall and spanning the opening in the top end of said container in position to prevent introduction of a child's head into said interior space, and (2) at least one opening that permits access to the contents of said container or through which the contents of said container may be discharged; and first and second cooperating retention means for releasably attaching said ingress-preventing means to said lid, said first cooperating retention means being located on said lid and said second cooperating retention means being located on said ingress-preventing means.

18. A container apparatus according to claim 17 wherein said first cooperating retention means on said lid comprises a plurality of pins extending into the interior space of said container, and said second cooperating retention means comprises a plurality of holes in said ingress-preventing means for receiving said pins.

19. A container apparatus comprising:

a container having a side wall defining the interior space of said container, a bottom end that is closed off by an end wall attached to said side wall, and a top end having an opening to said interior space;

a lid releasably attached to said top end so as to close off said opening;

means for preventing ingress into said container by small children when said lid is removed, said ingress-preventing means being mounted within said container adjacent said top end, said ingress-preventing means comprising (1) an object-intercepting section extending inwardly of said side wall and spanning the opening in the top end of said container in position to prevent introduction of a child's head into said interior space, (2) at least one opening that permits access to the contents of said container or through which the contents of said container may be discharged, and (3) an outer rim section attached to said side wall, said object-intercepting section including an inner object-intercepting ring and a plurality of ring-supporting struts extending between said ring and said outer rim section; and interacting means for retaining said ingress-preventing means within said container when said lid is removed; said interacting means comprising at least one groove in said side wall and at least one peripheral rib on said rim section disposed in said at least one groove;

said lid being provided with at least one pin extending into said container and said ingress-preventing means including at least one hole in said plurality of struts for receiving said pin.

20. A container apparatus according to claim 19 wherein said at least one pin is so constructed as to make a releasable locking connection with said at least one hole.

21. A container apparatus comprising:

a container having a side wall and a bottom end wall defining the interior space of said container, said container having a top end with an opening to said interior space, said top end opening being of such dimension as to readily permit a child's head to pass therethrough;

a lid releasably attached to said top end so as to close off said opening; and ingress-preventing means for preventing ingress into said container by the head of a child when said lid is removed, said ingress-preventing means being mounted within said container adjacent said top end, said ingress-preventing comprising (1) an outer rim section interlocked with said side wall of said container, (2) an object-intercepting section attached to and surrounded and supported by said outer rim section, said object-intercepting section extending inwardly of said side wall across the opening in the top end of said container and being shaped so as to prevent introduction of a child's head into said interior space, and (3) at least one opening that permits access to the contents of said container or through which the contents of said container may be discharged.

* * * * *

UNITED STATES PATENT AND TRADEMARK OFFICE

CERTIFICATE OF CORRECTION

PATENT NO. : 5,577,632

DATED : November 26, 1996

INVENTOR(S) : Henry Blanchette et al

It is certified that error appears in the above-indentified patent and that said Letters Patent is hereby corrected as shown below:

Claim 21, column 9, line 5, insert the word "means" after the term -- ingress-preventing --.

Signed and Sealed this

Eighteenth Day of March, 1997

*Attest:*

Bruce Lehman

BRUCE LEHMAN

*Attesting Officer*

*Commissioner of Patents and Trademarks*